United States Patent [19]

Kapolas

[11] 4,448,320

[45] May 15, 1984

[54] CLOSURE WITH PLASTISOL LINER DEFINING A RETAINING BEAD

[75] Inventor: William J. Kapolas, Mt. Prospect, Ill.

[73] Assignee: Continental White Cap, Inc., Northbrook, Ill.

[21] Appl. No.: 462,846

[22] Filed: Feb. 1, 1983

[51] Int. Cl.[3] ..... B65D 53/00

[52] U.S. Cl. ..... 215/346; 264/46.6; 264/268

[58] Field of Search ..... 215/346, 348, 321, 317, 215/318; 264/268, 46.6

[56] References Cited

U.S. PATENT DOCUMENTS 2,817,453 12/1957 Stover ..... 215/346 X 3,371,813 3/1968 Owen et al. ..... 215/318

*Primary Examiner*—Donald F. Norton

*Attorney, Agent, or Firm*—Charles E. Brown

[57] ABSTRACT

This relates to a closure utilizing a liner which is formed of plastisol or like material which puffs or expands upon curing after the liner has been applied. By providing the liner with a skirt portion and by increasing the radial thickness of a lower part of the liner skirt portion through a shaping of the skirt of the closure shell, the cured liner skirt portion will expand differentially and form, on the inner surface of the liner skirt portion, a bead which will snap over and lock beneath a bead on a container neck finish to lock the closure in a container sealing position. The closure may be removed and reapplied to reseal the container.

11 Claims, 5 Drawing Figures

CLOSURE WITH PLASTISOL LINER DEFINING A RETAINING BEAD

This invention relates in general to new and useful improvements in closures for containers wherein the closure is provided with a plastisol liner for forming a seal with the container neck finish, and more particularly to a modified closure wherein the plastisol liner has an integral bead for locking engagement on a container neck finish bead.

It is conventional to provide closure caps with a shell having disposed therein a plastisol liner for forming a seal with the end finish of a container. Such liners normally have primarily only an annular sealing surface, although the liners may extend slightly down the skirt of the shell. The plastisol liners are applied in their uncured state and then are cured, at which time a certain degree of expansion takes place and this improves the sealing properties of the liner. However, in order that the liner may be applied at a high production rate, it is contoured by means of a molding punch, and thus the internal surface of the skirt portion of the liner must be of a straight line configuration in cross section. Otherwise, there would be a wiping action as the molding punch is removed.

In accordance with this invention, the skirt portion of the plastisol liner, in its cured state, has a lower portion in the form of a locking or retention bead which projects radially inwardly beyond axially adjacent portions of the liner skirt portion. This bead, integrally formed on the liner skirt portion, is engageable beneath a bead on a container neck finish so as to retain the closure on the container against accidental removal, although it may be readily pried from the container.

A principal feature of this invention is the fact that the plastisol, when cured, expands or puffs. This characteristic of the liner material is beneficially utilized by varying the thickness of the liner in the skirt portion thereof. By making a lower part of the liner skirt portion of a greater thickness than the axially adjacent part, when the skirt portion expands radially inwardly upon curing, the thinner part expands to a certain degree while the thicker part expands to a much greater degree even when the percentage of puffing in the two parts is the same. Thus, by configurating the shell to have the lower part of the liner skirt portion of a greater thickness, the liner skirt portion may be provided with an integral bead after curing while the uncured liner will have a straight line cross-sectional interior surface.

A further feature of the invention is the utilization of a plastisol for forming the liner wherein the percentage of puffing increases, within limits, as the thickness of the plastisol increases.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
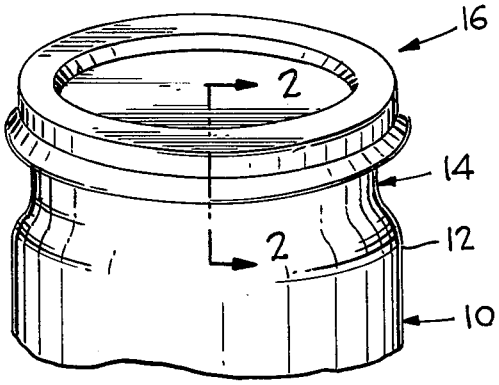
FIG. 1 is a top perspective view of a container closed by a closure formed in accordance with this invention.

Referring now to the drawings in detail, it will be seen that there is illustrated in FIG. 1 a conventional container 10 which includes a body 12 terminating at its upper end in a neck finish 14. The neck finish 14 carried a closure formed in accordance with this invention and generally indentified by the numeral 16.

Figure 2:
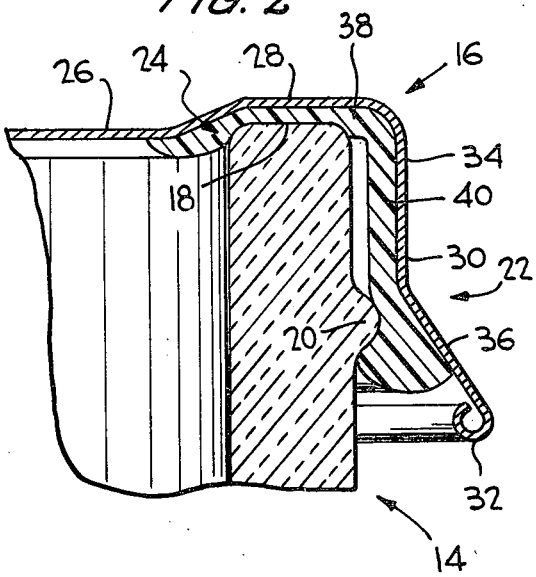
FIG. 2 is a transverse vertical sectional view taken generally along the line 2—2 of FIG. 1, and shows the specific cross section of the shell of the closure and the liner and the interlocking relationship between the liner and the container neck finish bead in accordance with this invention.

Referring now to FIG. 2, it will be seen that the illustrated container 10 if formed of glass, although it may be formed of other materials, and the neck finish 14 includes a free end sealing surface 18. The neck finish 14 also includes an external locking bead 20 which is integrally formed on the outer surface of the neck finish 14 and is axially spaced below the sealing surface 18.

In the normal formation of closures such as the closure 16, there is a contoured shell 22 which is provided with a plastisol liner, generally identified by the numeral 24. The shell 22 may be provided with a radially inwardly directed locking bead or other means for direct locking engagement with the container neck finish. Normally, the liner 24 is of an extent only to assure sealing with the surface 18.

The shell 22, for the most part, is of a conventional construction and includes an end panel 26 surrounded by an axially inwardly opening channel portion 28. The shell 22 also includes a generally cylindrical skirt 30 which terminates in an integral inwardly directed curl 32. Normally, the liner 24 is primarily restricted to the channel 28 and does not materially extend axially down the skirt.

In accordance with this invention, instead of the skirt 30 being cylindrical the full height thereof, the skirt 30 has an upper cylindrical portion 34 and a radially outwardly and downwardly flared lower portion 36. Further, the liner 24, in addition to including an annular seal forming portion 38, also includes a skirt portion 40. It is this skirt portion 40 to which the invention primarily relates.

Figure 3:
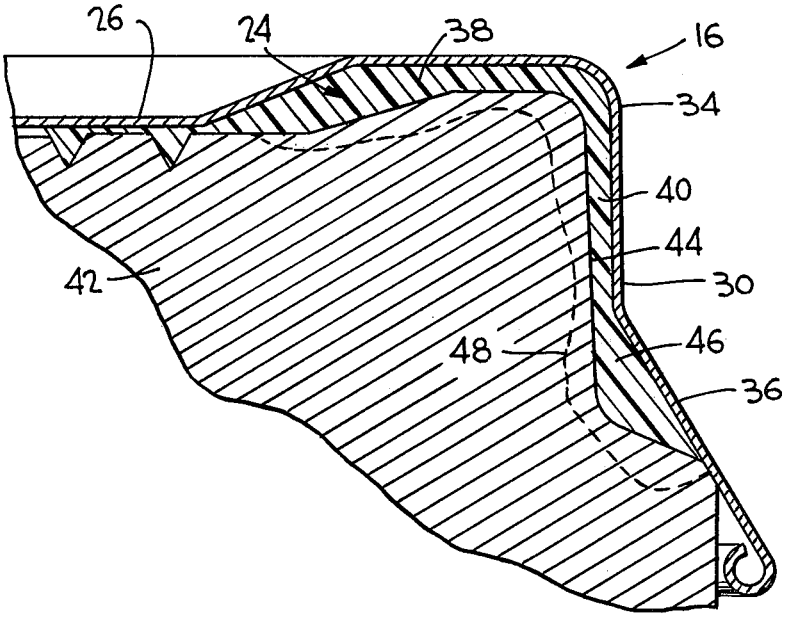
FIG. 3 is an enlarged sectional view taken through the closure showing in solid lines the contour of the plastisol liner as applied, and in dotted lines the puffed plastisol liner after curing.

Referring now to FIG. 3, it will be seen that the liner 24 is contoured by means of a molding punch 42 to the preselected contour with the plastisol which forms the liner being in its uncured state. Because the molding punch 42 must be withdrawable, it is obvious that it cannot have any liner forming projections or recesses in the peripheral surface thereof. Therefore, the as applied uncured plastisol liner 24 must have, in the skirt portion thereof, an internal surface which, in cross section, is a straight line. This internal surface is identified by the numeral 44 and preferably has a slight slope thereto so as to facilitate the withdrawal of the molding punch 42. It will be readily apparent that this slope must be radially outwardly and axially downwardly.

Considering first the assumption that upon being heated and cured the plastisol material of the liner 24 will expand or puff and that the expansion will be of a uniform rate irrespective of thickness, it will be seen that the internal contour of the liner 24 will be modified from the uncured contour in accordance with variation in thickness of the liner. Thus, by radially outwardly enlarging the shell skirt 30 and thereby providing for an increased thickness in the lower part of the liner skirt portion 40, as at 46, it will be apparent that when the liner material puffs upon being curved this increase in thickness of the liner material at 46 will result in a radially inwardly directed greater expansion of the lower part of the skirt portion as opposed to the radially inwardly directed expansion of an axially adjacent part of the liner skirt portion. Thus, by properly contouring the skirt of the shell 16, the lower part of the cured plastisol liner skirt 40 can be expanded to define a radially inwardly directed bead identified by the numeral 48.

Figure 5:
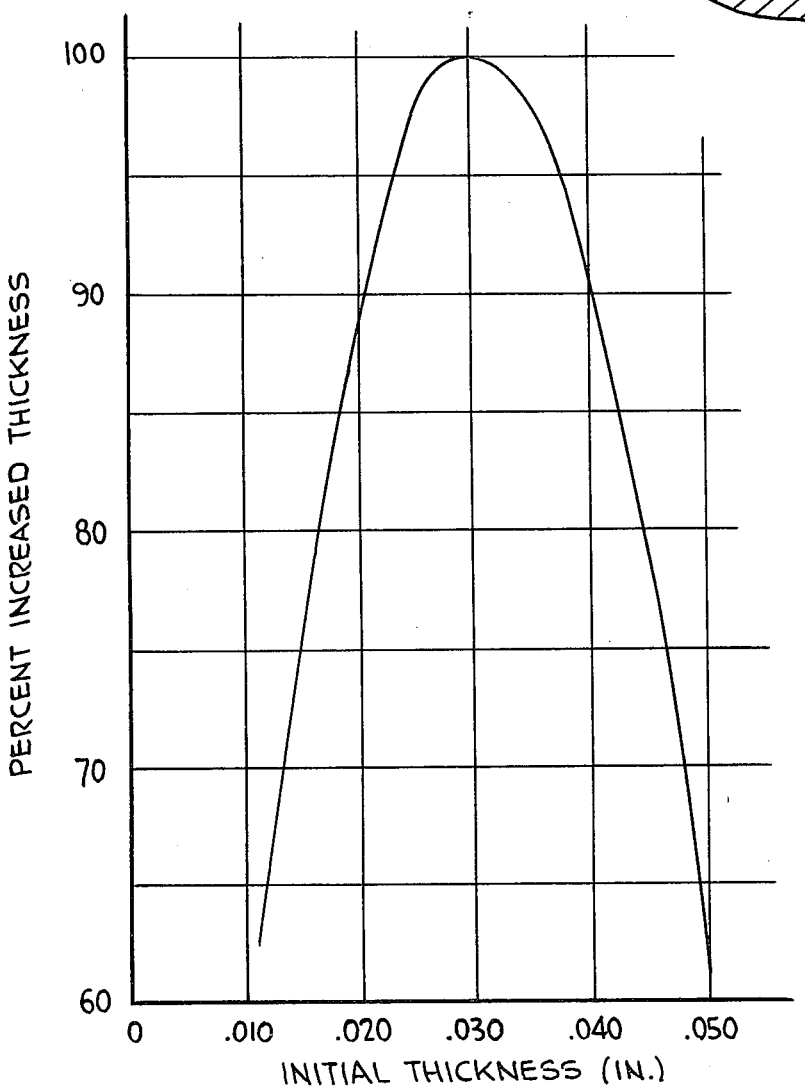
FIG. 5 is a graph showing puff percentage plotted against initial liner thickness.

Referring now to the graph of FIG. 5 it has been found that with certain plastisols, particularly plasticized polyvinyl chloride that contains additives such as pigments, lubricants, stabilizers, and puffing agents, the percentages of which additives vary depending upon the closure type and package treatment.

The plastisols, upon curing, do not uniformly puff, but that there is an increase in the puff rate of such plastisols in accordance with an increase in thickness. It will be seen that when the thickness varies between 0.010" and 0.031", there is a marked increase in puff rate with an increase in thickness until the puff rate increase drops off in generally the same manner as it rises, approaching a puff percentage of 50% when the initial liner thickness is on the order of 0.050".

Figure 4:
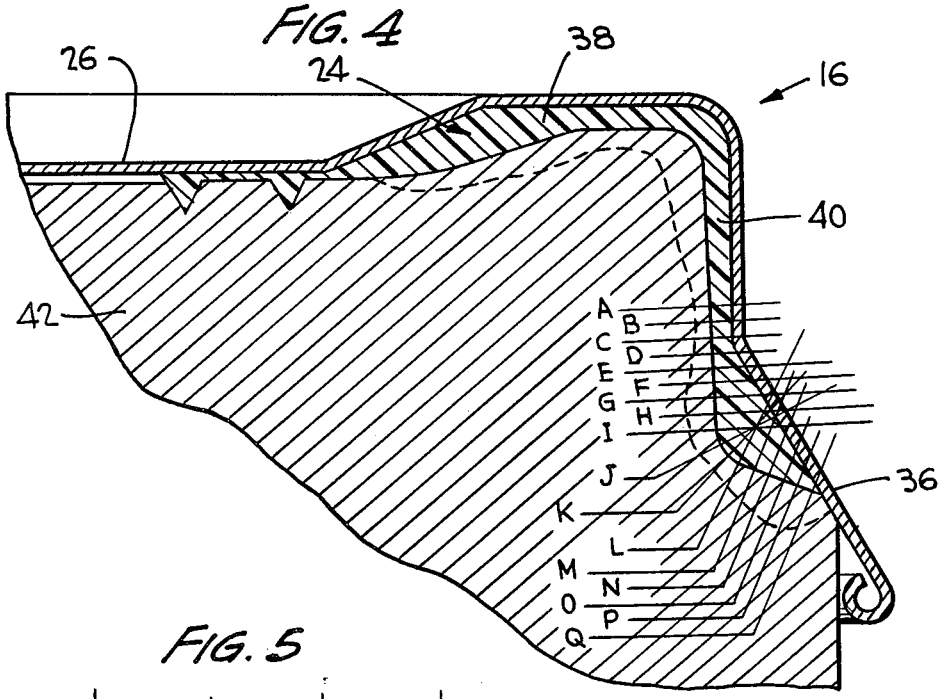
FIG. 4 is an enlarged sectional view similar to FIG. 3, but having thereon a number of lines upon which test dimensions were taken of both the as applied plastisol and cured plastisol.

With particular reference to FIG. 4, it will be seen that the actual thicknesses of the lower part of the liner skirt, both uncured and cured, was taken along a series of lines with the following results:

| | DIFFERENTIAL PUFF | |
|---|---|---|
| POSITION | INITIAL THICKNESS | FINAL THICKNESS (ACTUAL) |
| A | .013 | .026 |
| B | .012 | .024 |
| C | .013 | .025 |
| D | .016 | .030 |
| E | .020 | .040 |
| F | .025 | .046 |
| G | .031 | .052 |
| H | .036 | .059 |
| I | .041 | .064 |
| J | .041 | .060 |
| K | .040 | .058 |
| L | .042 | .059 |
| M | .036 | .060 |
| N | .029 | .058 |
| O | .021 | .054 |
| P | .013 | .045 |
| Q | .007 | .032 |

Inasmuch as the thickness of the plastisol of the uncured liner 24 may fall within this increased puff rate for the particular plastisol, this can be advantageously utilized to control the puffing in the applied area 46 of the liner to specifically define the bead with a contour which will interlock beneath the bead 20 of the container neck finish. It is to be understood that by controlling the radial outward enlargement of the skirt 30 of the shell, the contour of the bead 48 may be specifically controlled.

The closure 16, as thus formed, may be applied to the container 10 by a pressing on of the closure and the bead 48 will engage over and beneath the bead 20 with a "snap" action. The bead 48, upon application of the closure to the container neck finish, wedges underneath the bead 20.

The closure, when applied as set forth above, may be readily pried off or thumbed off, depending upon the contour of the bead 48. After removal of the closure, resealing is simply accomplished by applying the closure on top the neck finish and pressing down until an audible snap occurs. When this occurs, the container has been resealed.

Although only a preferred embodiment of the closure has been specifically illustrated and described herein, it is to be understood that minor variations may be made in the closure, most particularly the contour of the skirt of the shell and the contour of the liner skirt portion, without departing from the spirit and scope of the invention as defined by the appended claims.

I claim:

1. A closure comprising a shell having a cured plastisol liner wherein the plastisol is in a puffed state, said liner having a lower radially inwardly directed locking bead formed solely due to the puffed state of said plastisol for locking engagement beneath a container neck finish bead.

2. A closure according to claim 1 wherein said shell has a cylindrical upper portion and is radially outwardly enlarged in the area of said bead with the thickness of said liner at said bead being greater than the thickness of said liner in axially adjacent portions of said liner due to said puffed state.

3. A closure according to claim 2 wherein said liner terminates below said bead in a tapered ramp which terminates at said shell intermediate ends of said shell enlargement.

4. A closure according to claim 1 wherein said plastisol has a puff rate which increases with thickness.

5. An intermediate article of manufacture for forming a closure having a cured plastisol liner with said liner having a lower radially inwardly directed locking bead, said intermediate article comprising a shell having in the interior thereof a liner of uncured plastisol, said liner including a skirt portion having an internal surface free of radially inwardly directed projections, and said shell adjacent a portion of said liner skirt being radially outwardly enlarged wherein the thickness of a lower portion of said liner skirt is greater than the thickness of an adjacent portion of said liner.

6. An intermediate article according to claim 5 wherein said plastisol is of the type which puffs when cured whereby thickened areas increase in thickness to greater linear extent than thinner areas.

7. An intermediate article according to claim 6 wherein said plastisol has a puff rate which increases with thickness.

8. A method of forming a closure of the type including a shell having a plastisol liner for sealing engagement with a container, said method comprising the steps of providing a shell having a skirt and wherein a lower portion of said skirt is radially outwardly enlarged, applying an uncured plastisol liner to the shell with the liner having a skirt portion extending axially into overlapped relation with the outwardly enlarged portion of the shell skirt whereby a lower portion of the liner skirt is of a greater thickness than an axially adjacent portion of the liner skirt, and then curing the liner effecting a puffing of the plastisol of the liner with the resultant greater radial expansion of the liner skirt portion of greater thickness defining on the liner skirt an integral radially inwardly directed locking bead for locking engagement with a bead on a container neck finish.

9. The method of claim 8 wherein the skirt of the uncured liner has an interior surface which is a straight line in cross section.

10. The method of claim 8 wherein the uncured liner is contoured by means of a molding punch.

11. The method of claim 8 wherein the plastisol has a puff rate which increases with thickness.

* * * * *